US007458160B2

(12) United States Patent
Escobar et al.

(10) Patent No.: US 7,458,160 B2
(45) Date of Patent: Dec. 2, 2008

(54) ERGONOMIC HANDLE FOR SCISSORS AND OTHER TOOLS

(75) Inventors: Juan Carlos Escobar, New York, NY (US); Justin John Adelff, Pittsburgh, PA (US); Dino Anthony Mariano, Pittsburgh, PA (US)

(73) Assignee: Helen of Troy Limited, St. Michael (BB)

( * ) Notice: Subject to any disclaimer, the term of this patent is extended or adjusted under 35 U.S.C. 154(b) by 169 days.

(21) Appl. No.: 11/268,244

(22) Filed: Nov. 7, 2005

(65) Prior Publication Data

US 2007/0101582 A1 May 10, 2007

(51) Int. Cl.
*B26B 13/00* (2006.01)
*B26B 13/12* (2006.01)

(52) U.S. Cl. ..... 30/232; 30/254

(58) Field of Classification Search ..... 30/232, 30/254, 340, 341; 76/106.5; D8/57
See application file for complete search history.

(56) References Cited

U.S. PATENT DOCUMENTS

| | | | | |
|---|---|---|---|---|
| 109,192 | A | 11/1870 | Du Bois | |
| 301,043 | A | 6/1884 | Brooks | |
| 422,670 | A | 3/1890 | Wallace | |
| 464,075 | A | 12/1891 | Krank | |
| 598,031 | A | 1/1898 | Steen | |
| 667,914 | A | 2/1901 | Klever, Jr. | |
| 1,299,100 | A | 4/1919 | Anderson | |
| 1,507,529 | A | 9/1924 | Sundman | |
| 1,759,553 | A | 5/1930 | Henautt | |
| 1,970,983 | A | 8/1934 | Smith | |
| 2,184,909 | A * | 12/1939 | Crompton | D8/57 |
| 2,778,254 | A | 1/1957 | Carapellotti | |
| 3,072,955 | A | 1/1963 | Mitchell | |
| 3,894,336 | A * | 7/1975 | Desimone | 30/341 |
| 4,658,456 | A | 4/1987 | Tsai | |
| 4,662,372 | A | 5/1987 | Sharkany et al. | |
| 4,776,096 | A | 10/1988 | Chang | |
| 4,901,440 | A | 2/1990 | Go et al. | |
| 4,914,820 | A * | 4/1990 | Saito | 30/254 |
| 4,942,637 | A | 7/1990 | Yeang-Yai | |
| 5,035,054 | A | 7/1991 | Ellenberger | |
| 5,125,751 | A | 6/1992 | Coigley | |

(Continued)

FOREIGN PATENT DOCUMENTS

JP 52041981 A * 3/1977

*Primary Examiner*—Jason Daniel Prone
(74) *Attorney, Agent, or Firm*—Seyfarth Shaw LLP

(57) ABSTRACT

An ergonomic handle for use with a hand tool, such as a pair of scissors or the like, is disclosed which includes first and second opposing lever members coupled together at a pivot point to permit reciprocating movement of the lever members between a closed position and an open position. The lever members may include a cutting blade or other tool feature on a first end adjacent the pivot point, and a handle on a second end adjacent the pivot point opposite the first end. The fixed handle has a loop portion which includes an inner surface and an outer surface along one side of which abuts a corresponding outer surface of the opposing lever member while in the closed position. Each loop portion is made from a rigid material segment and a resilient material segment, with the rigid material segment having a cavity open at the outer loop surface and the resilient material segment extending across the cavity at the inner loop surface.

23 Claims, 3 Drawing Sheets

U.S. PATENT DOCUMENTS

D338,604 S * 8/1993 Ramsey ..... D8/57
5,419,045 A 5/1995 Magdich
5,435,447 A 7/1995 Weatherford et al.
5,459,929 A 10/1995 Linden et al.
D365,004 S 12/1995 Ramsey et al.
5,778,540 A * 7/1998 Huang ..... 30/232
D398,210 S 9/1998 Tanaka
5,819,416 A 10/1998 Robinson et al.
D409,465 S 5/1999 Olix et al.
5,926,912 A 7/1999 Claphan
5,974,670 A 11/1999 Hsieh
D419,047 S 1/2000 Jacquet
D431,436 S 10/2000 Gstalder
6,131,223 A 10/2000 Rehkemper et al.
6,226,872 B1 5/2001 Kline
6,334,255 B1 1/2002 Chang
6,341,424 B1 * 1/2002 Kenny et al. ..... 30/232
6,397,478 B1 * 6/2002 Bornancini ..... 30/232
D460,671 S 7/2002 Chan
6,427,338 B1 * 8/2002 Schmidt ..... 30/232
6,493,947 B2 12/2002 Stokes
6,523,264 B1 2/2003 Albert et al.
6,523,266 B2 2/2003 Yang
D471,779 S * 3/2003 Chen ..... D8/57
D473,438 S 4/2003 Manson et al.
D478,438 S 8/2003 Solowiej
6,640,378 B2 11/2003 Hsu
6,643,935 B1 11/2003 Lowe, Sr. et al.
D483,635 S 12/2003 Silver et al.
6,665,939 B1 * 12/2003 Adachi ..... 30/232
D485,736 S 1/2004 Phillips et al.
6,721,997 B2 4/2004 Hua
6,739,057 B2 5/2004 Schallenberg
D502,371 S 3/2005 Pia
D523,715 S * 6/2006 Siegel ..... D8/57
D543,817 S * 6/2007 McLean ..... D8/57
D551,928 S * 10/2007 Peterson et al. ..... D8/57
D565,373 S * 4/2008 Fazzi et al. ..... D8/57
D574,685 S * 8/2008 Peterson et al. ..... D8/57
2002/0095796 A1 7/2002 Whitehall et al.
2002/0170181 A1 * 11/2002 Schallenberg ..... 30/232
2004/0159197 A1 8/2004 Foreberg et al.
2005/0044721 A1 * 3/2005 Phillips et al. ..... 30/230
2005/0283980 A1 * 12/2005 Bathard et al. ..... 30/131
2006/0123634 A1 * 6/2006 Peterson et al. ..... 30/232
2007/0017104 A1 * 1/2007 Hasegawa ..... 30/232

* cited by examiner

ERGONOMIC HANDLE FOR SCISSORS AND OTHER TOOLS

TECHNICAL FIELD

The present invention relates generally to an ergonomic handle for tools, more specifically, to an ergonomic handle for tools having a scissoring action, such as, for example, scissors.

BACKGROUND

Scissors are commonly configured to include two pivotably interconnected lever members having a handle and a cutting blade on opposite sides of the pivot point. The two opposing cutting blades are typically comprised of a cleanly-sharpened cutting edge of stainless steel or other hard metal, which culminate in a point and frictionally overlap as they are brought together. The handle on each lever member is typically comprised of a closed or open loop with one loop being sized for a user's thumb and the other for a user's first finger or two. The loops are generally made of a rigid material, either a plastic or the same metal material of the blades.

In use, the fingers and thumb of a user are placed into the handle loops with the remaining fingers coming to rest on the outer surface of the handle loops. A repeated opening and closing motion creates a cutting effect at the overlapping blades. This repeated motion, if prolonged, can tire the user's hand muscle and irritate the contacting skin on the user's fingers within and around the handle loops.

Some prior art devices have attempted to alleviate some discomfort by providing a resilient material applied to the outer surface of both handle loops. The resilient material cushions somewhat the impact on the user's fingers. However, those skilled in the art have failed to address cushioning of other key areas of the scissor handles.

Thus, there is a need, generally, for an ergonomic handle that provides a user with sufficient cushioning and minimizes discomfort and fatigue during prolonged use of a particular tool. Specifically, a need exists for an ergonomic handle for scissors which provide comfort to the user's fingers during use.

SUMMARY

There is disclosed generally herein, an improved ergonomic tool handle which includes improved features for providing a user with cushioned finger loops to minimize development of fatigue during prolonged use.

Accordingly, it is an object of the invention to specifically provide scissors comprising first and second opposing lever members coupled together at a pivot point to permit reciprocating movement of the lever members between a closed position and an open position. The lever members comprise a cutting blade on a first end adjacent the pivot point, and a handle on a second end adjacent the pivot point opposite the first end, and including a fixed loop portion having an inner loop surface and an outer loop surface which abuts along a length a corresponding length of the outer loop surface of the opposing lever member while in the closed position. Each loop portion includes a rigid segment and a resilient segment, the rigid segment defining a loop having a cavity open at the outer loop surface, the resilient segment extending across the cavity at the inner loop surface.

It is a further object wherein the resilient segment is configured to deflect upon application of a force. The resilient segment is preferably formed of a resilient material and shaped to extend into the loop portion of each lever.

An illustrative embodiment of the present invention relates to a handle for a tool having opposing members operated in a scissoring action, the handle comprising a first lever member pivotally coupled to a second lever member at a pivot point to permit the first lever member to reciprocate between a first position and a second position relative to the second lever member. A handle portion is attached to at least one of the first and second lever members at an end adjacent the pivot point, and includes an inner surface and an outer surface. The handle portion includes a rigid material segment and a resilient material segment, the rigid material segment defining a cavity positioned within the outer loop surface open at the outer loop surface, the resilient material segment extending across the cavity along at least one of either the inner loop surface and the outer loop surface.

A more detailed explanation of the invention is provided in the following description and claims and is illustrated in the accompanying drawings.

BRIEF DESCRIPTION OF THE DRAWINGS

For the purpose of facilitating an understanding of the subject matter sought to be protected, there is illustrated in the accompanying drawings an embodiment thereof, from an inspection of which, when considered in connection with the following description, the subject matter sought to be protected, its construction and operation, and many of its advantages should be readily understood and appreciated.

DETAILED DESCRIPTION

Figure 1:
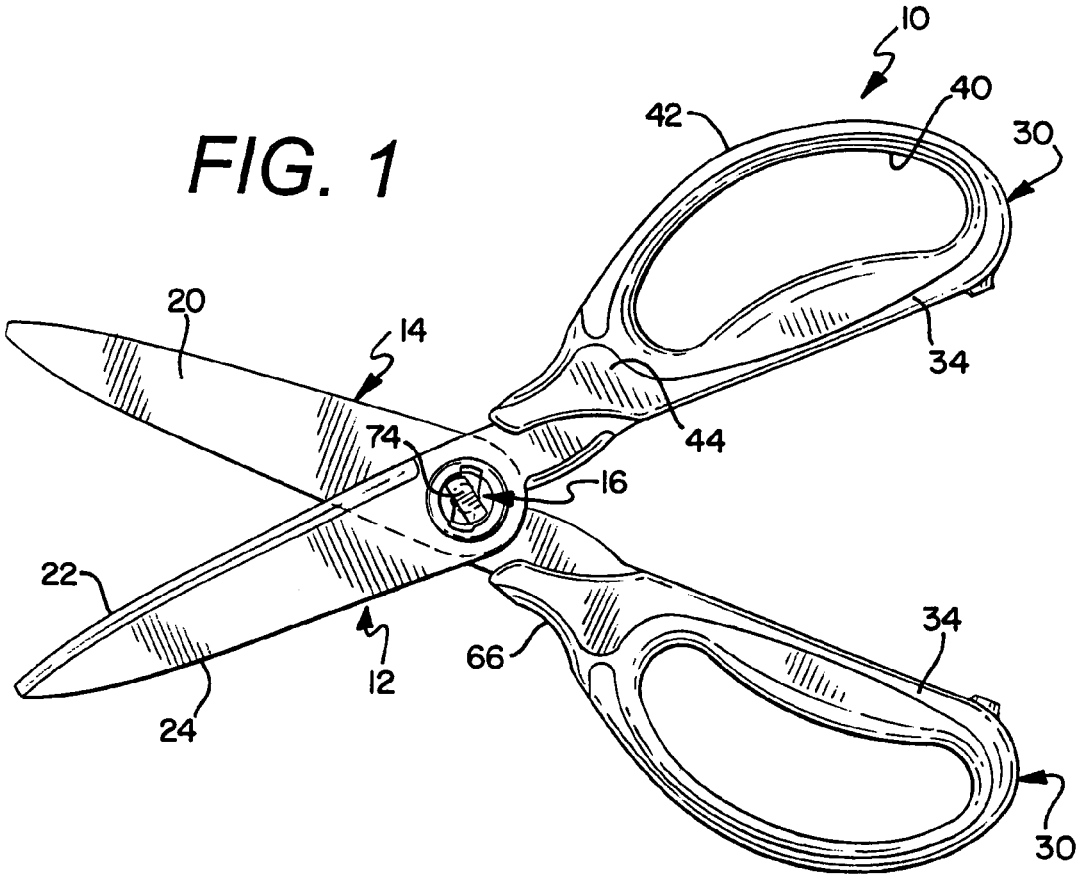
FIG. 1 is a side view of one embodiment of the present scissors in an open position.

While this invention is susceptible of embodiments in many different forms, there is shown in the drawings and will herein be described in detail a preferred embodiment of the invention with the understanding that the present disclosure is to be considered as an exemplification of the principles of the invention and is not intended to limit the broad aspect of the invention to the embodiment illustrated.

Referring to FIGS. 1-8, there is depicted a scissor, generally depicted by the number 10 throughout this application. Likewise, each reference number used herein will refer consistently to a single component throughout this application, as well as in all relevant drawing figures. While the present invention is almost exclusively shown and described in terms of scissors 10, it will be appreciated that the unique handles of this application may be applied to most any hand tool which benefits from the scissor-like mechanics and finger-loop handle of the present invention.

Scissors 10 include a first lever 12 and a second lever 14 interconnected through an aperture in each lever by a pin or some other suitable means at pivot point 16. Each lever 12, 14 is preferably divided at the pivot point 16 into two distinct portions.

The first portion is a cutting blade 20. Blade 20 is typically comprised of a length of tool-cut material, preferably a stainless steel, though many other suitable metals and non-metals are known to those skilled in the art, having a sharpened front edge 22 opposite a blunted back edge 24. The blade 20 may culminate in a pointed end or tip 26, as shown in FIG. 2, or it may be rounded, squared-off, etc. (not shown). Additionally, the sharpened front edge 22 may take the form of a smooth cutting surface (FIG. 1) or it may be configured with a serrated, scalloped, or any other possible cutting edge (not shown) known by those skilled in the art.

Figure 2:
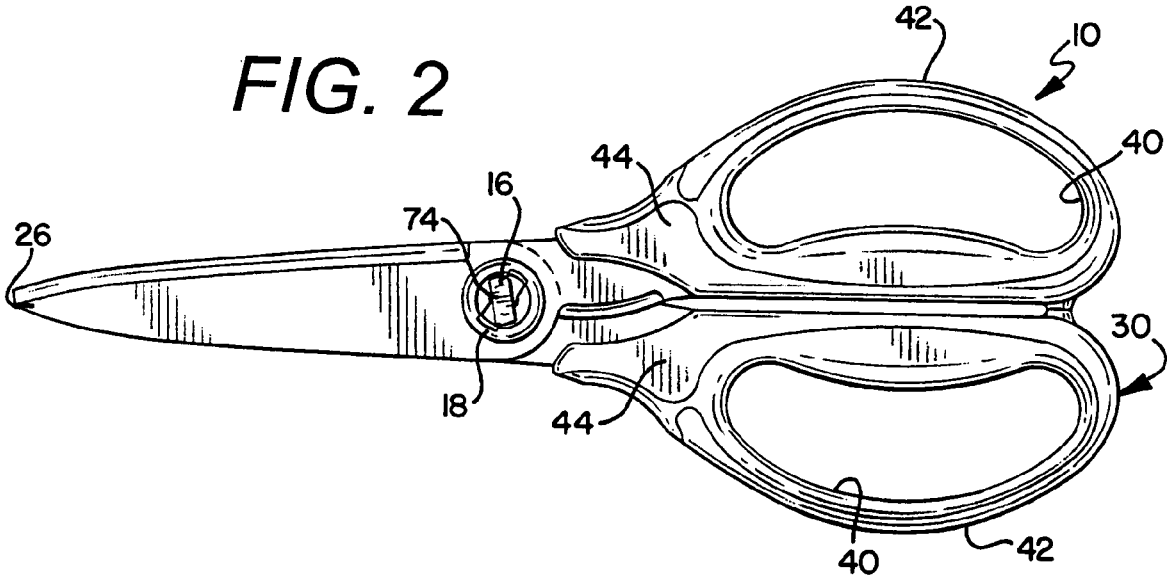
FIG. 2 is a side view of the embodiment of FIG. 1, shown in a closed position.

When interconnected, first and second levers 12, 14 form an X in an open position, as shown in FIG. 1. The sharpened front edge 22 of each lever 12, 14 is in a facing relationship with one another such that as the edge 22 of each lever 12, 14 is brought together, they meet first at a point most proximate the pivot point 16 and progressively overlap a distance until the tip 26 of each lever 12, 14 overlap.

The cutting blade 20 may be designed to cut paper of various thicknesses, metal or wire of various gauge, plant stalks, branches and limbs of various sizes, or any other material for which it is desirable to cut. Modification of the presently disclosed cutting blade to achieve such results, usually by changing the blade thickness, cutting edge, blade length, etc., would be well within the skill of those in the art.

Further, the cutting blade 20 may be substituted for by other tool components. For example, though not shown, clamping surfaces may be used to grasp, clamp, or otherwise manipulate materials. Alternatively, the tool ends may be used to crimp, ply, stamp, hold, twist, scoop, mold, etc., a material needing of such manipulation.

Regarding the handle 30 of each lever 12, 14, FIGS. 3-6 most readily illustrate the key features of this component.

Figure 3:
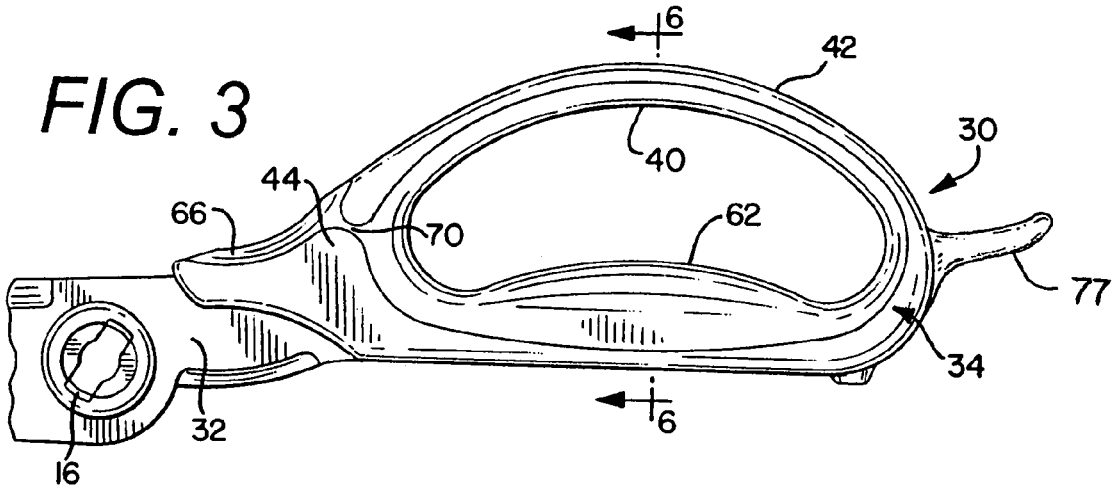
FIG. 3 is an enlarged side view of the handle loop portion of one lever of the embodiment of FIG. 1.
Figure 4:
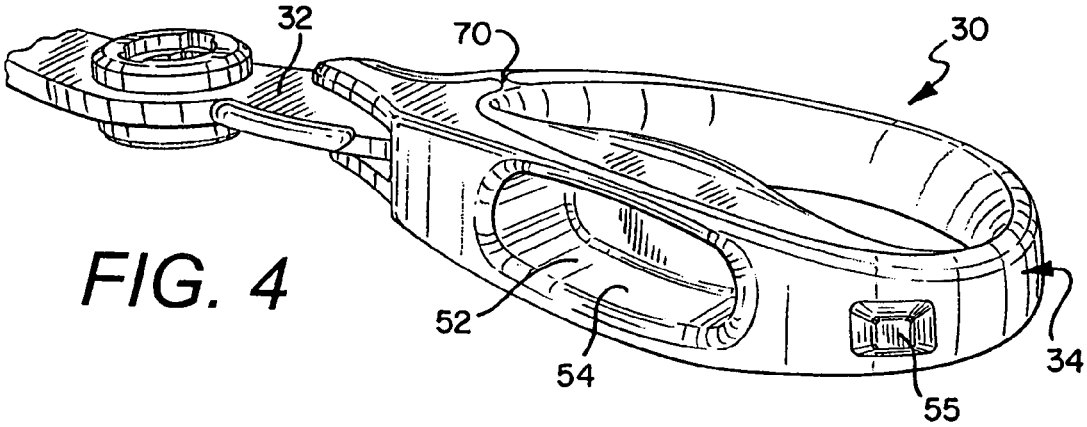
FIG. 4 is a bottom perspective of the handle loop portion shown in FIG. 3.

Each handle 30 extends from the pivot point 16 to form a tang 32. The tang 32 is most preferably integral to the cutting blade 20, and is most easily formed of the same material. The tang 32 extends a distance from the pivot point 16 which is most suitable for the attachment of loop portion 34, as shown in FIGS. 3 and 4. Preferably, the loop portion 34 is a separately molded component having an inner loop surface 40, an outer loop surface 42, and body 44. The loop portion 34 is preferably sized to account for the positioning of a user's fingers—i.e., where greater power is required to make cuts, such as for cutting thick paper, metal and the like, user fingers are typically placed further into the loops—and may be of most any desired shape. The two individual loops may be of the same or different sizes and shapes as well.

The loop portion 34 is preferably produced by injection molding a rigid material directly to the tang 32 and then overlaying a resilient material along the inner loop surfaces 40 and at key areas of the body 44. Suitable rigid material includes polypropylene, glass-filled polypropylene, nylon, ABS. Additionally, suitable resilient material includes thermoplastic rubber (TPR), such as SANTOPRENE™, and many other elastomeric materials.

Figure 5:
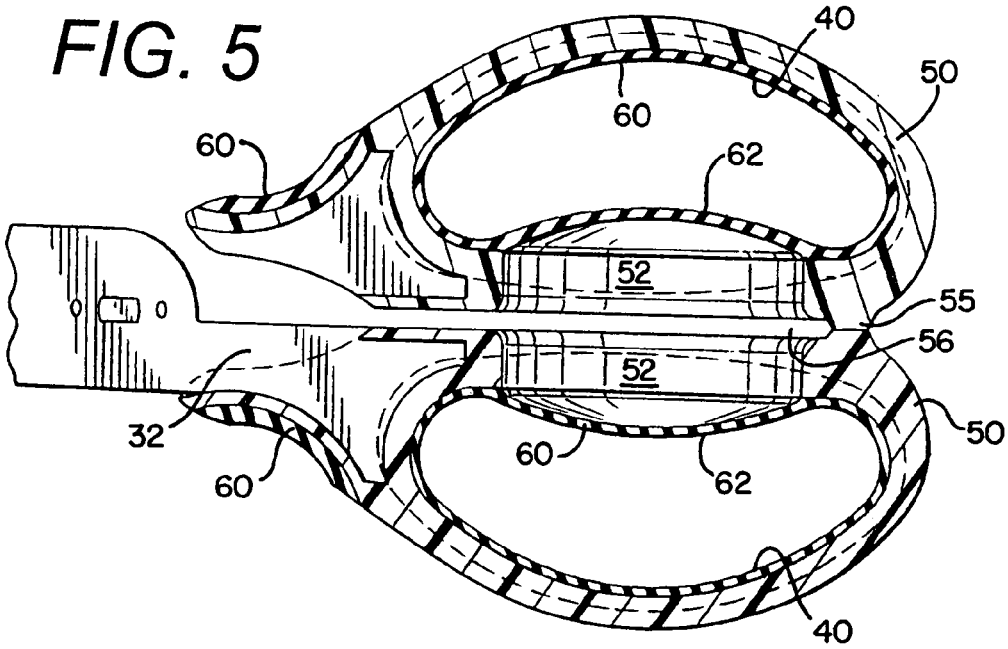
FIG. 5 is a cross section of the handle loop of both levers shown in the embodiment of FIG. 2.
Figure 6:
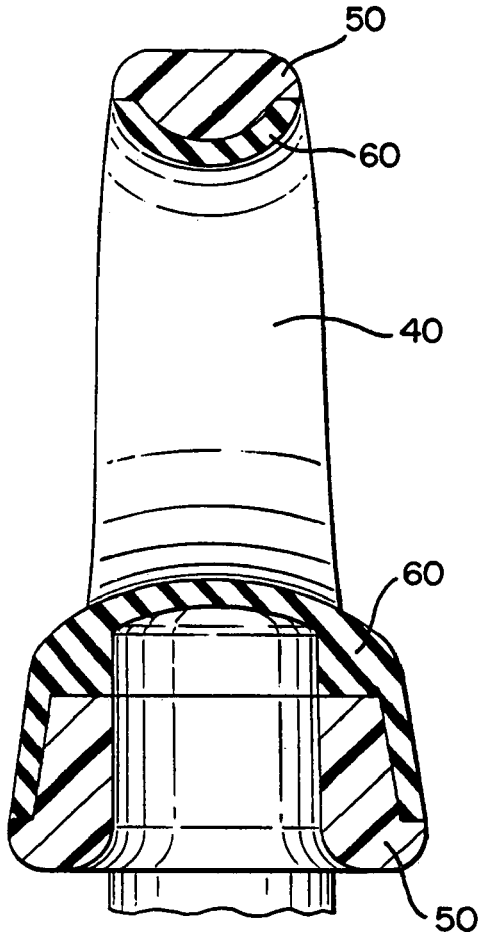
FIG. 6 is a cross-section taken along line 6-6 of FIG. 3.
Figure 7:
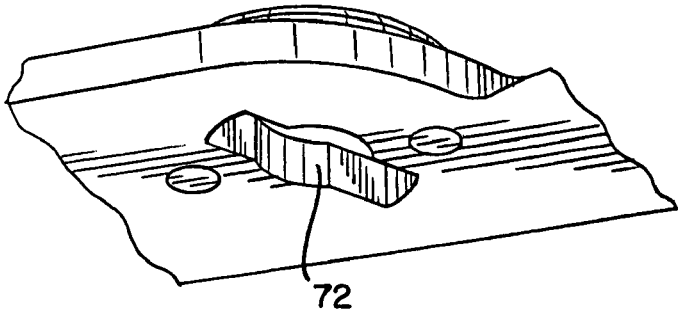
FIG. 7 is an enlarged cut-away of the underside of one embodiment of the pivot point used to connect the two levers.

Referring to FIG. 5, the cross-section of the two handles 30 are shown. The rigid material segment 50 preferably forms a complete loop as well as a substantial portion of the body 44 surrounding a portion of the tang 32. However, the section of the loop portion 34 which forms the inner edge comprises an obround cavity or hollow 52 defined by wall 54 (FIG. 4).

The hollow 52 is formed using a slider positioned within the loop portion mold during the molding process. Essentially, the slider has a size dimension and a shape dimension which exactly conforms to that of the desired cavity or hollow, and its use allows formation of a surface without which such a surface would not be possible. When positioned, the slider prevents the injection molded material from forming in a specific area of the loop portion mold. Upon completion of the material injection and curing of the rigid material, the slider is removed. This process is well-known and understood by those skilled in the art of injection molding.

The rigid material segment 50 may also comprise a stop 55. The stop 55 is also positioned on the inner edge of the loop portion 34. Collectively, the stops 55 help prevent pinching the user's skin by stopping the handles 30 at a distance apart to form a gap 56, as shown in FIG. 5. They are also effective in preventing overextension of the levers 12, 14 when moving to a closed position.

Once the rigid material segment 50 is formed onto the tang 32 of the handle, the resilient material segment 60 can be formed. Again, this segment 60 is overmolded to the rigid material segment 50 along the inner loop surface 40 and at the finger rest area 66 of the body 44. The resilient material segment 60 comprises a raised area 62 which, because it extends across the hollow 52 of the rigid material segment 50, is significantly unsupported.

The raised area 62 is formed in much the same way as the hollow 52. A slider with the desired size and shape dimensions is positioned during the injection of the resilient material. Upon curing, the slider is removed and the raised area 62 remains. Obviously, the raised area 62 can be configured to most any size and shape which adequately covers hollow 52 along the inner loop surface 40. The hollow 52 remains open to the opposite surface, as shown in FIG. 5.

The combination of the hollow 52 and the unsupported raised area 62 provides a spring action to the scissors during use. The thickness of the resilient material used may be varied to achieve the desired combination of cushioning, comfort, and spring. The raised area 62 for each handle 30 may be identical or different, preferably depending on the loop handle configuration itself.

In addition to the inner loop surface 40 having resilient material, the finger rest area 66 of the body 44 may include resilient material as well. This may be added during the same molding process as the overmolding of resilient material segment 60 to the inner loop surface, or it may be done by a completely separate step. If done simultaneously, the resilient material may be either injected through a different gate for the target area, or a channel 70 in the surface of the rigid material segment 50, as shown best in FIG. 3, may be used to allow the resilient material to flow from the inner loop surface 40 to the target finger rest area 66. Alternatively, a sub-surface tunnel (not shown) could be used through the rigid material segment 50 to give the appearance of separate components by hiding the flow path internally. The addition of a tunnel or channel to the rigid material segment 50 would require a second slider during the molding process.

The handle 30 may also comprise a finger grip 77. The finger grip 77 is positioned near the inner edge of the loop portion 34 of handle 30 of either lever 12 or 14. The finger grip 77 may be formed of resilient material, including TPR. The finger grip 77 may further be joined to the resilient segment through such means as a channel through the rigid material segment 50 or a bore through the rigid material segment 50, as is well-known and understood by those skilled in the art of injection molding.

Figure 8:
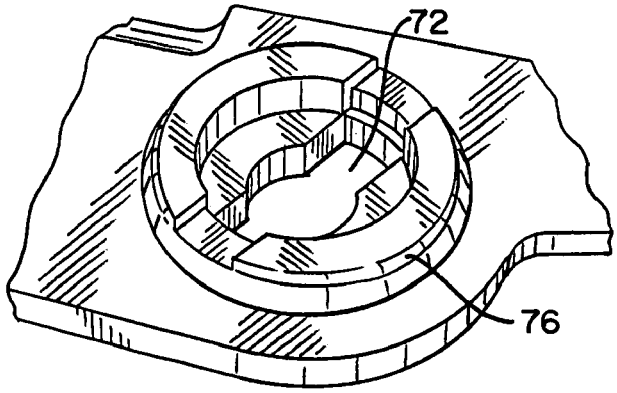
FIG. 8 is an enlarged cut-away of the topside of the pivot point shown in FIG. 7.

Finally, a ring 76 of material, rigid or resilient, may be molded around the pivot point of the two levers, as shown in FIG. 8. While the illustrated embodiment demonstrate the use of a slot 72 and tab 74 (FIG. 1) to provide the pivot point 16, any known connecting method which allows the two levers 12, 14 to pivot relative to one another would be suitable. A non-removable cap (not shown) made from a material similar to that of the ring 76 may also be utilized to prevent dust, debris and the like from interfering with the pivot mechanism.

From the foregoing, it can be seen that there has been provided an improved handle for hand tools, such as scissors 10, which greatly facilitate prolonged, as well as short-term use. While the preferred embodiments described herein incorporate the handle loops in combination with a pair of scissors 10, it should be understood that the handle may be separately and independently incorporated into other embodiments of a hand tool, such as, e.g., pruning shears, pliers, wire cutters, tin snips, crimpers, tongs, and other such tools of similar design.

The matter set forth in the foregoing description and accompanying drawings is offered by way of illustration only and not as a limitation. While particular embodiments have been shown and described, it will be apparent to those skilled in the art that changes and modifications may be made without departing from the broader aspects of applicants' contribution. The actual scope of the protection sought is intended to be defined in the following claims when viewed in their proper perspective based on the prior art.

What is claimed:

1. Scissors comprising:

first and second opposing lever members coupled together at a pivot point to permit reciprocating movement of the lever members between a closed position and an open position, each lever member comprising:

a cutting blade on a first end of each of said lever members adjacent the pivot point, and a handle on a second end of each of said lever members adjacent the pivot point opposite the first end and each of said handles including a fixed handle loop having an inner loop surface, an outer loop surface, and a hollow cavity defined within the handle loop and extending from an opening on the inner loop surface to an opening on the outer loop surface, a length of the outer loop surface being parallel to a corresponding length of the outer loop surface of the opposing lever member and abutting at a stop protruding from the outer loop surface of each handle while in the closed position, wherein each handle comprises a rigid segment and a resilient segment, the rigid segment defining the inner and outer loop surfaces and the resilient segment forming a convex surface spanning the opening on the inner loop surface of the corresponding cavity.

2. The scissors of claim 1, wherein the convex surface of the resilient segment is configured to deflect upon application of a force.

3. The scissors of claim 1, wherein the resilient segment is interior to the rigid segment.

4. The scissors of claim 1, wherein the resilient segment is made from a resilient material.

5. The scissors of claim 1, wherein the handle further comprises a finger grip located on the outer loop surface of the handle.

6. The scissors of claim 5, wherein the finger grip comprises a resilient material.

7. The scissors of claim 5, wherein the finger grip is made of a resilient material identical to a material of the resilient segment of the handle loop.

8. The scissors of claim 7, wherein the finger grip is connected to the resilient segment of the handle.

9. The scissors of claim 7, wherein the resilient material is a TPR.

10. The scissors of claim 7, wherein the finger grip is joined to the resilient segment.

11. The scissors of claim 10, wherein the finger grip is joined to the resilient segment through a channel on a surface of the rigid segment.

12. The scissors of claim 10, wherein the finger grip is joined to the resilient segment through a bore within the rigid segment.

13. The scissors of claim 1, wherein the pivot point comprises a slot on the first lever member and a corresponding interlocking tab on the second lever member.

14. The scissors of claim 13, further comprising a guide ring positioned about the slot to direct the corresponding interlocking tab into the slot.

15. The scissors of claim 1, wherein the resilient segment is over-molded to the rigid segment.

16. A handle for a tool having opposing members operated in a scissoring action, the handle comprising:

a first lever member pivotally coupled to a second lever member at a pivot point to permit the first lever member to reciprocate between a first position and a second position relative to the second lever member;

a handle attached to at least one of the first and second lever members at an end adjacent the pivot point, and including an inner loop surface, an outer loop surface, and a hollow cavity extending from an opening on the inner loop surface through the handle to an opening on the outer loop surface, wherein the handle comprises a rigid segment and a resilient segment, the resilient segment forming a convex surface spanning the opening on the inner loop surface of the corresponding cavity.

17. The handle of claim 16, wherein the convex surface of the resilient segment is configured to deflect upon application of a force.

18. The handle of claim 16, wherein the resilient segment is interior to the rigid segment.

19. The handle of claim 16, wherein the resilient segment is made from a resilient material.

20. The handle of claim 19, wherein the resilient material is a TPR.

21. The handle of claim 16, wherein the pivot point comprises a slot on the first lever member and a corresponding interlocking tab on the second lever member.

22. The handle of claim 21, further comprising a guide ring positioned about the slot to direct the corresponding interlocking tab into the slot.

23. The handle of claim 16, wherein the resilient segment is over-molded to the rigid segment.

* * * * *